United States Patent [19]

Takeda et al.

[11] Patent Number: 4,922,278

[45] Date of Patent: May 1, 1990

[54] DEVELOPING APPARATUS

[75] Inventors: Morihiro Takeda; Eiji Miyasaka; Masayuki Handa, all of Hikone, Japan

[73] Assignee: Dainippon Screen Mfg. Co., Ltd., Japan

[21] Appl. No.: 199,208

[22] Filed: May 26, 1988

[30] Foreign Application Priority Data

May 27, 1987 [JP] Japan ..... 62-81623[U]

[51] Int. Cl.[5] ..... G03D 3/12

[52] U.S. Cl. ..... 354/320; 354/339; 355/27

[58] Field of Search ..... 354/320, 321, 322, 338, 354/339; 355/27; 226/170, 171, 172; 134/64 P, 122 P

[56] References Cited

U.S. PATENT DOCUMENTS

| | | | |
|---|---|---|---|
| 3,589,263 | 6/1971 | Casey | 354/322 |
| 4,019,667 | 4/1977 | Falmo | 226/171 |
| 4,119,991 | 10/1978 | Martino | 354/320 |
| 4,148,576 | 4/1979 | Martino | 354/320 |
| 4,174,901 | 11/1979 | Takita | 134/122 P |
| 4,464,035 | 8/1984 | Schoering | 354/322 |

FOREIGN PATENT DOCUMENTS 61-34154 3/1986 Japan .

*Primary Examiner*—A. A. Mathews

*Attorney, Agent, or Firm*—Ostrolenk, Faber, Gerb & Soffen

[57] ABSTRACT

A developing apparatus for developing a presensitized plate comprises a developer tank for storing a developer, a feed roller provided at an upper portion of the feeding side of the developer tank for feeding the presensitized plate into the developer tank, a discharging roller provided at an upper portion of the discharging side of the developer tank for discharging the presensitized plate from the developer tank, a feeding belt extending below the feed roller and from the surface of the developer into the developer for guiding the presensitized plate, a pressing roller for pressing the presensitized plate fed by the feed roller onto the conveyor belt, and a guide plate provided between the pressing roller and the discharging roller for guiding the presensitized plate.

13 Claims, 3 Drawing Sheets

DEVELOPING APPARATUS

BACKGROUND OF THE INVENTION

1. Field of the Invention

The present invention relates to a developing apparatus for developing a presensitized plate and, more particularly, it relates to a developing apparatus in which unevenness is not generated during development.

2. Description of the Prior Art

A developing apparatus of particular interest to the present invention is disclosed in Japanese Utility Model Laying-Open No. 34154/1986 entitled "A Cooling Apparatus for a Copying Machine" which is assigned to the applicant of the present invention. FIG. 1 shows a conventional developing apparatus. The developing apparatus is contained within a copying machine 30.

The presensitized plate to be developed comprises a plastic film base and an emulsion layer formed thereon. The emulsion layer comprises a silver halide photosensitive surface such as silver halide emulsion. After development and fixation, the presensitized plate is used as an offset printing plate.

Referring to FIG. 1, a conventional developing apparatus comprises a developer tank 33 for storing a developer 32, a feed roller 36 provided on the side of a presensitized plate inlet 34 of the developer tank 33 for feeding the presensitized plate 35 into the developer 32, a discharging roller 38 provided on the side of a presensitized plate outlet 37 of the developer tank 33 for discharging the presensitized plate 35 into a stabilizing unit 42, and a guide member 41 provided in the developer tank 33 for guiding the fed presensitized plate 35 to the discharging roller 38. The guide member 41 comprises a conveyer path 40 for guiding the presensitized plate 35.

The exposed presensitized plate 35 is fed through the presensitized plate inlet 34 and the feed roller 36 along the conveyer path provided in the developer tank 33 while immersed in the developer. The immersed presensitized plate 35 is fed through the discharging roller 38 into the stabilizing unit 42 for the succeeding step of the process.

FIG. 2 is an enlarged view showing the feed roller 36. Referring to FIG. 2, the feed roller 36 comprises a pair of pinch rollers **36*a* and 36*b* and an auxiliary roller 36*c*** provided thereunder.

The presensitized plate 35 which is fed by the pinch rollers **36*a* and 36*b* is introduced into the developer 32 via the auxiliary roller 36*c***. Since the above described developing apparatus has relatively a simple structure, it is often used within copying machines and the like.

However, recently the sensitivity of presensitized plates has been improved. Since the sensitivity in development has been enhanced, the development of the presensitized plate 35 becomes uneven if there are even small ripples in the developer. The above described conventional developing apparatus, presents the following problems: Referring to FIG. 1, when the presensitized plate 35 is discharged from the developer tank 33, the edge of the plate 35 runs against the discharging roller 38. When this happens, the feeding of the presensitized plate 35 is momentarily stopped. However, at the other side of the developer tank 33, the presensitized plate 35 is still being fed. Consequently, the presensitized plate 35 is bent. This situation is shown in phantom in FIG. 2 in an exaggerated manner. As shown, the presensitized plate 35 is forced back in the direction of the arrow A. Therefore, ripples are formed on the surface of the liquid S near the introducing side of the developer tank 33. The ripples cause unevenness in development. The same situation occurs when the rear edge of the presensitized plate 35 passes the feed roller 36.

SUMMARY OF THE INVENTION

Therefore, one object of the present invention is to provide a developing apparatus in which unevenness in developing a presensitized plate does not occur.

Another object of the present invention is to provide a developing apparatus in which the presensitized plate does not vibrate in the developer.

A further object of the present invention is to provide a developing apparatus in which the surface of the developer does not ripple during developing.

The above objects of the present invention can be attained by a developing apparatus which includes a developer tank having two end portions; feeding roller means provided on the upper portion of one of the end portions for feeding the said presensitized plate into the said developer tank; discharging roller means provided on the upper portion of the other end portion of the said developer tank for discharging the said presensitized plate; belt means provided in alignment with the said feeding roller means which has a portion extending from the surface of the said developer into the developer and rotates for guiding the said presensitized plate; pressing roller means which receives between the said belt means the presensitized plate fed by the said feeding roller means and presses the same onto the said belt means; and belt holding roller means for holding and rotating the said belt means.

The presensitized plate is guided by the belt means and is fed while being pressed by the pressing roller. Therefore, even if the presensitized plate runs against the discharging roller, there is no adverse effect on the presensitized plate at the other side of the tank. Consequently, the surface of the developer does not ripple during development. Therefore, unevenness in developing the presensitized plate does not occur.

According to a preferred embodiment of the present invention, the presensitized plate pressed by the pressing roller means is guided by a guiding means from the pressing roller means to the discharging roller means.

Since the developing apparatus is structured as described above, the presensitized plate is continuously fed from the pressing roller means to the discharging roller means. As a result, the presensitized plate has no influence on the surface of the developer when the plate is discharged.

According to another preferred embodiment of the present invention, the guide means comprises a portion extending from the pressing roller means of the belt means to the discharging roller means.

Since the developing apparatus is structured as described above, the presensitized plate is continuously guided from the inlet side to the outlet side of the developing apparatus. Therefore, the presensitized plate does not vibrate by encountering obstructions.

According to a further preferred embodiment of the present invention, the discharging roller means comprises a set of two rollers provided in upper and lower positions which rotate in contact with each other to pinch the presensitized plate therebetween to feed the same, and the belt holding roller means comprises one roller in the lower side of the discharging roller means.

Since the developing apparatus is structured as described above, the presensitized plate encounters nothing from the feeding portion to the discharging portion of the developer tank. In addition, it is pressed by the roller means while being fed from the feeding portion to the discharging portion. Therefore, a developing apparatus can be provided in which the feeding of the presensitized plate has no influence on the surface of the developer.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 3:
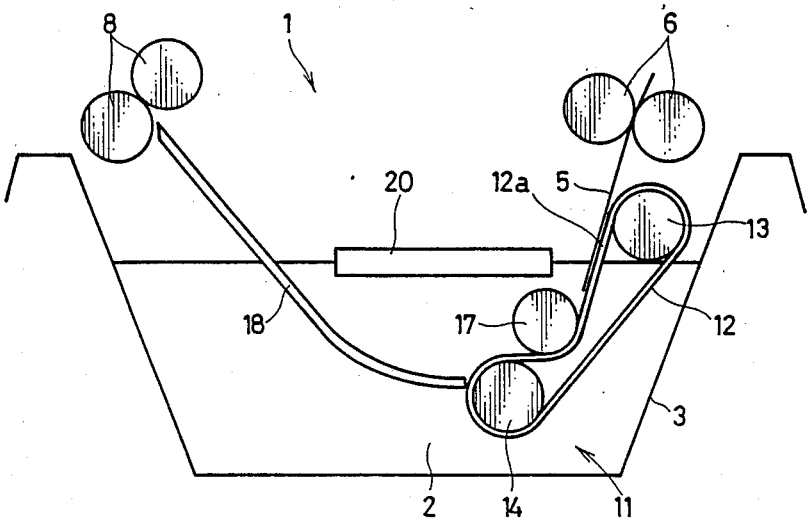
FIG. 3 is a cross sectional view showing the developing apparatus of the present invention.

FIG. 3 is a schematic cross sectional view of a developing apparatus showing a first embodiment in accordance with the present invention.

Referring to FIG. 3, the developing apparatus 1 comprises a developer tank 3 containing a developer 2, a pair of feed rollers 6 provided at the inlet to the developer tank 3 for feeding the presensitized plate 5 into the developer 2, a discharging pair of rollers 8 provided at the outlet from the developer tank 3 for discharging the presensitized plate 5 and a guide unit 11 for guiding the presensitized plate 5 along the conveyer path to the discharging roller 8. The presensitized plate 5 is continuously introduced and fed into the developer 2 during the developing process. After development, the presensitized plate 5 is discharged by the discharging roller 8 to the stabilizing unit of a succeeding apparatus. A plate 20 for preventing oxidation floats on the developer in order to cover the surface of the developer as much as possible. The plate 20 also serves to prevent the formation of ripples on the surface of the developer.

The characteristics of the guide unit in accordance with the present invention will now be described. The guide unit 11 comprises a conveyer belt 12 for introducing the presensitized plate 5 into the developer, a pressing roller 17 for pressing the plate 5 into the conveyer belt 12 and a guiding plate 18 arranged downstream of the conveyer belt 12 for guiding the presensitized plate 5 to the discharging 5 rollers 8.

The conveyer belt 12 is wrapped as an endless belt around a set of rollers 13 and 14 and the introducing portion 12*a* thereof is provided at the surface of the developer. The conveyer belt 12 is provided along the direction in which the presensitized plate is fed by the feed roller 6. The presensitized plate 5 is mounted on the conveyer belt 12 for introduction to the developer 2.

Figure 1:
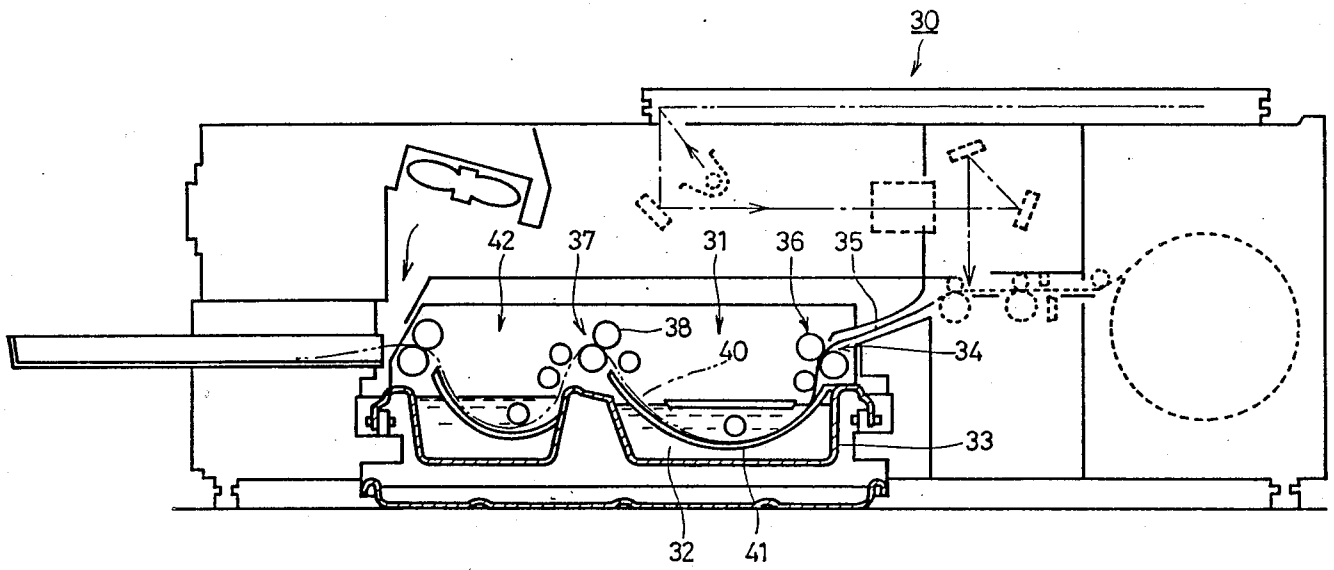
FIG.1 PRIOR ART
FIG. 1 is a cross sectional view showing the conventional developing apparatus described above.
Figure 2:
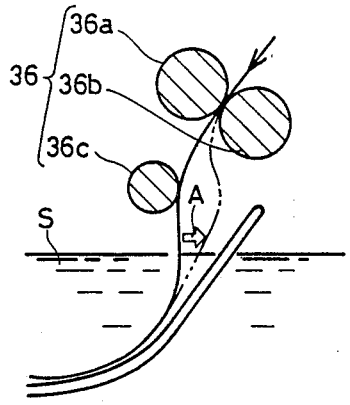
FIG.2 PRIOR ART
FIG. 2 is an enlarged view of the feed roller portion of FIG. 1.

A pressing roller 17 is submerged in the developer and the presensitized plate 5 is pressed by the pressing roller 17 onto the conveyer belt 12. The presensitized plate 5 is guided along the guiding plate 18 being pressed by the pressing roller 17 and fed to the discharging roller 8. During this time, the developing process is carried out. Since the presensitized plate 5 is pressed by the pressing roller 17 onto the conveyer belt, the presensitized plate 5 cannot move in the direction of the arrow A shown in FIG. 2. Consequently, the presensitized plate 5 is fed smoothly without being subjected to any shock. When the front edge of the presensitized plate 5 runs against the discharging roller 8, shock is absorbed by the conveyer belt 12 and the pressing roller 17. Consequently, the presensitized plate 5 is not adversely affected by ripples or the like.

Figure 4:
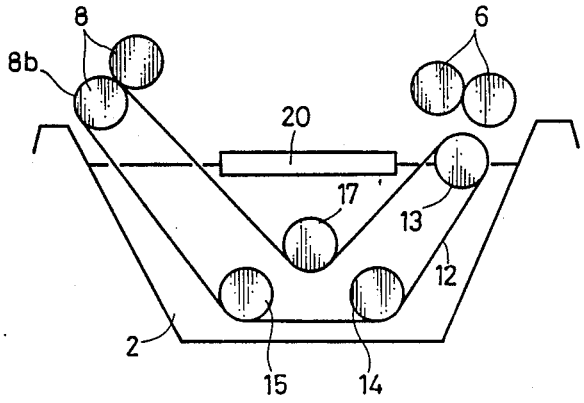
FIG. 4 is a cross sectional view showing another embodiment of the developing apparatus of the invention.

FIG. 4 shows a second embodiment of the present invention. In this embodiment, the guiding plate 18 of the first embodiment is omitted and the conveyer belt 12 serves as the guiding plate 18.

The guide unit which corresponds to the guide unit 11 of the first embodiment comprises a set of rollers 13, 14 and 15, a conveyer belt 12 wrapped on one discharge roller 8*b* and a pressing roller 17 which is pressed on the conveyer belt 12.

In this embodiment, the conveyer belt 12 is provided along the feeding direction with the feeding side portion of the belt being positioned at the surface of the developer.

Figure 5:
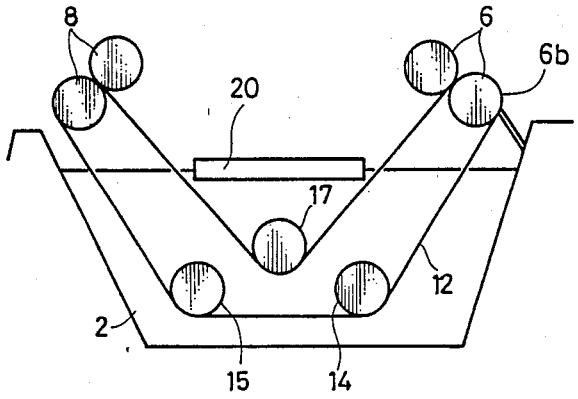
FIG. 5 is a cross sectional view showing a further embodiment of the developing apparatus of the invention.

FIG. 5 shows a third embodiment of the present invention. In this embodiment, the roller 13 of the second embodiment is replaced by a roller 6*b* of the feeding rollers 6. Since the apparatus of FIG. 5 is otherwise structured as described above, the apparatus of FIG. 5 has a simpler structure than that of the apparatus of FIG. 4.

Since the developing apparatus comprises the above described components, the rear portion of the presensitized plate is held by the conveyer belt and the pressing roller even if the front edge of the presensitized plate runs against the discharging roller and the edge momentarily stops. Therefore, the shock of the encounter has no influence on the introducing side of the presensitized plate. When the rear edge of the presensitized plate parts from the feeding roller, the rear end portion of the presensitized plate is introduced into the developer while being mounted on the conveyer belt. Therefore, the presensitized plate does not form ripples on the surface of the developer. Consequently, unevenness in developing the presensitized plate due to such ripples or the like, does not occur.

Although the present invention has been described and illustrated in detail, it is clearly understood that the same is by way of illustration and example only and is not to be taken by way of limitation, the scope of the present invention being limited only by the terms of the appended claims.

What is claimed is:

1. A developing apparatus for developing a presensitized plate comprising:

a developer tank having one end portion and the other end portion for storing a developer;

feeding roller means provided on an upper portion of the one end portion of said developer tank for feeding said presensitized plate into said developer tank;

discharger roller means provided on an upper portion of the other end portion of said developer tank for discharging said presensitized plate;

belt means provided in alignment with said feeding roller means, said belt means having a portion extending from the surface of said developer into the developer and rotates for guiding said presensitized plate;

pressing roller means which presses the presensitized plate fed by said feeding roller means onto said belt means;

belt holding roller means for holding and rotating said belt means; and guide means, including a guide plate which is separate from said guide belt means, for guiding a presensitized plate pressed by said pressing roller means from said pressing roller means to said discharging roller means; said belt means including a delivering portion for delivering said presensitized plate to said guide plate, said guide plate including one end for receiving said presensitized plate and another end for delivering said presensitized plate to said discharging roller; one end of said guide plate being aligned with said delivering portion of said belt means, and the other end of said guide plate being aligned with said discharging roller.

2. A developing apparatus according to claim 1, wherein said belt holding roller means comprises a first belt holding roller more than half thereof is above the surface of said developer and a second belt holding roller provided on the side opposed to said first belt holding roller in relation to said pressing roller means, said belt means is held by said first belt holding roller and said second belt holding roller, and said delivering portion comprises a portion of said belt means which portion is going to be wrapped around said second belt holding roller.

3. A developing apparatus according to claim 2, wherein said feeding roller means comprises a set of two rollers provided in an upper direction and a lower direction which rotate being in contact with each other to pinch said presensitized plate therebetween to feed the same, and said first belt holding roller comprises the lower one roller of said feeding roller means, whereby said belt means constitutes a part of said feeding roller means.

4. Apparatus for developing a presensitized plate, said apparatus comprising:

a tub containing a treatment solution;

a presensitized plate;

means for transporting said plate from an entry position located above said treatment solution, through said treatment solution, and to an exit portion located above said treatment solution, said transporting means including at least one roller located at said entry position, the entire said roller being located above said surface of said treatment solution; and means for suppressing the formation of ripples on the surface of said treatment solution by preventing said presensitized plate from moving in a direction parallel to the surface of said treatment solution as it enters said solution from said entry position, said suppressing means including means for pressing said presensitized plate against said transporting means.

5. Apparatus according to claim 4, wherein said pressing means is located below said surface of said treatment solution.

6. Apparatus according to claim 5, wherein said transporting means includes a belt, said pressing means including a roller for pressing said presensitized plate against said belt.

7. Apparatus according to claim 6, wherein said suppressing means further comprises an antioxidation plate which is in contact with a substantial portion of said surface of said treatment solution.

8. Apparatus according to claim 7, wherein said antioxidation plate is generally flat.

9. Apparatus according to claim 7, wherein said antioxidation plate floats in said treatment solution.

10. Apparatus for developing a presensitized plate, said apparatus comprising:

a tub containing a treatment solution;

a presensitized plate;

means for transporting said plate from an entry position located above said treatment solution, through said treatment solution, and to an exit portion located above said treatment solution, said transporting means including at least one roller located at said entry position, the entire said roller being located above said surface of said treatment solution; and means for suppressing the formation of ripples on the surface of said treatment solution; and wherein said transporting means further includes a guide belt extending from a position above said surface of said solution adjacent said entry position to a position under said surface of said solution, said guide belt guiding said presensitized plate into said treatment solution.

11. Apparatus according to claim 10, wherein said suppressing means comprises a pressing roller located under said surface of said treatment solution to press said presensitized plate against said belt; said at least one roller, said guide belt and said guide belt and said pressing roller cooperating to prevent said presensitized plate from moving in a direction parallel to said surface of said treatment solution as said plate is passed through said surface of said treatment solution in the area of said entry position.

12. Apparatus for developing a presensitized plate, said apparatus comprising:

a tub containing a treatment solution;

a presensitized plate;

means for transporting said plate from an entry position located above said treatment solution, through said treatment solution, and to an exit portion located above said treatment solution, said transporting means including at least one roller located at said entry position, the entire said roller being located above said surface of said treatment solution; and means for suppressing the formation of ripples on the surface of said treatment solution; and wherein said at least one roller is a pair of abutting rollers located above said surface of said treatment solution and wherein said transport means further includes a second pair of abutting rollers located above said surface of said treatment solution at said exit location; and wherein said transporting means further includes a guide belt for guiding said presensitized plate into said treatment solution and at least partially through said treatment solution.

13. Apparatus according to claim 12, wherein said belt guides said presensitized plate through said treatment solution and out of said treatment solution.

* * * * *